US005427414A

United States Patent [19]

Fletcher et al.

[11] Patent Number: 5,427,414

[45] Date of Patent: Jun. 27, 1995

[54] PAGE HOLDING BOOKMARK

[76] Inventors: Douglas D. Fletcher, 310 Aspen St., Alexandria, Va. 22305; Barbara A. Rusnak, 4535 Flamingo Dr., Gainesville, Va. 22065

[21] Appl. No.: 178,968

[22] Filed: Jan. 7, 1994

Related U.S. Application Data

[63] Continuation-in-part of Ser. No. 64,826, May 17, 1993, abandoned.

[51] Int. Cl.[6] ..... B42D 9/00

[52] U.S. Cl. ..... 281/42; D19/34

[58] Field of Search ..... 281/42; D19/34; 116/234–240

[56] References Cited

U.S. PATENT DOCUMENTS

| | | | |
|---|---|---|---|
| 865,092 | 9/1907 | Erickson | 116/235 |
| 1,100,780 | 6/1914 | Ridenour | 116/238 |
| 1,579,438 | 4/1926 | Cortelyou | 281/42 |
| 1,809,943 | 6/1931 | Ockenden | 116/239 |
| 2,645,197 | 7/1953 | Jones et al. | 116/238 |
| 3,129,695 | 4/1964 | Adelman | 116/240 |
| 4,014,508 | 3/1977 | Weiss | 281/42 X |
| 4,395,057 | 7/1983 | Young | 281/42 |
| 4,569,538 | 2/1986 | Kurschner | 281/42 |
| 5,054,816 | 10/1991 | Rosengarten | 281/42 |
| 5,165,722 | 11/1992 | Wong | 281/42 |

FOREIGN PATENT DOCUMENTS

| | | | |
|---|---|---|---|
| 17930 | 8/1903 | United Kingdom | 116/237 |

*Primary Examiner*—Frances Han

*Attorney, Agent, or Firm*—Harold H. Dutton, Jr.

[57] ABSTRACT

A device for holding pages of a book and marking a place in a book comprising an elongated strip of a flexible, non-extendible material having a length greater than the width of the book with which it will be used, when the book is open, a flexible, elastic cord connected to the elongated strip near the ends of the strip and being of a length such that the elastic cord is in a substantially unstretched state when not in use, the strip and the elastic cord having sufficient respective flexibility and extendibility as to extend over the full width of a book when opened and whereby the elastic cord will stretch and the strip will flex as the book is moved from a full open position to a partial open position to allow turning of the pages of the book in either direction.

3 Claims, 1 Drawing Sheet

PAGE HOLDING BOOKMARK

CROSS-REFERENCE TO RELATED APPLICATION

This application is a continuation-in-part of our application Ser. No. 08/064,826 filed May 17, 1993 now abandoned.

This invention relates to a device for holding books open while reading, or for marking a particular place in a book. More particularly, the invention relates to a device which serves to hold a book open for reading, and which allows for turning the pages of the book, either forward or backward, without removing the device from its holding position.

BACKGROUND AND OBJECTS OF THE INVENTION

A great many bookmarks are known in the prior art for marking a reader's place in a book when the book is set aside. Frequently such devices are temporarily inserted between pages so that when the book is closed, the place is marked by the presence of the device, enabling the book to be reopened to the same place at a later time. The simplest of such devices is merely a ribbon attached to the binding.

Other devices are known which serve to hold a book open to a particular page in order that the reader may continue to read without the use of his or her hands to hold the book open. For example, a reader laying on a beach may find that the wind blows the pages, thus necessitating the use of the hands or some other device to hold the book open and keep the pages from blowing around. Also, frequently one reads a book while performing a variety of tasks with one's hands, for example in a kitchen or in a workshop, and a need exists for keeping the book open.

One prior device is shown in U.S. Pat. No. 5,152,553, and includes a clip like section for engaging one page, and an extending wing portion for resting against and holding the facing page. The device appears to be much like a large paper clip, however, the presence of the wing portion prevents turning of the pages of the book, or closing of the book, without complete removal of the device.

Another prior device is shown in U.S. Pat. No. 5,054,816, and includes two different loops which are pivotally connected together. The loops may encircle the desired portion of a book in order to keep the book open, or may encircle the complete book in order to keep the book closed. However, while the pages may be turned in one direction, the device must be removed in order to turn pages in the other direction.

Still another prior art device is shown in U.S. Pat. No. 1,579,438 for holding a book open. This device consists of two straight, non-stretchable flat strips which are secured together at their ends. One of the strips is more flexible than the other in order that it will slightly bend, while the other strip remains rigid. An open book is inserted between the two strips, which then hold the book in that position. The device may be slid up or down on the book, but the device must be removed to turn the pages without damaging them.

Another known device comprises a transparent front hold down arm having a free end and a hinge end, a rear hold down arm having a free end and a hinge end, and a hinge portion connecting the hinge ends, to urge the front and rear arms together so as to clamp onto the open book and hold it flat for reading. In order for this device to adjust to different thickness of books, the hinge must be bigger than the thickest book, making the device rather bulky. It too must be removed in order to turn the pages.

These prior patents do not enable the user to readily turn the pages of the book without essentially removing the device from the book. Further, the prior devices, which do hold a book open, are not well suited for use as a bookmark, or conversely, if they serve well as a bookmark, do not adequately hold the book open for reading.

Accordingly, a primary object of the present invention is to provide an improved combination of a bookmark and page holder.

Another object of the invention is to provide a combined bookmark and pageholder which overcomes the drawbacks of prior art devices.

A further object of the invention is to provide an improved bookmark pageholder combination which allows turning of the pages without removal from the book.

Still a further object of the invention is to provide an improved bookmark pageholder combination which allows turning of the pages either forward or backward without removal from the book.

Yet another object of the invention is to provide an improved bookmark and pageholder combination which allows the book to be opened or closed to or from the desired page without removal from the book.

DESCRIPTION OF THE INVENTION

The present invention provides a combined bookmark and pageholder which allows the user to easily hold a book open in a reading position, allows the reader to turn pages either forward or backward without removing the device from the book, allows the reader to close the book or open the book, and allows marking the page being read, all without removing the device from the book.

The device comprises a thin strip of a semi-flexible but non-extendible material, such as a clear, hard plastic strip which can be flexed or bent slightly, but when released returns to a flat configuration. The strip may be made of either a transparent material in order that it does not interfere with the reading material, or may be made of an opaque material in which case it may bear any desired indicia.

A stretchable cord-like member has its ends attached to the plastic strip near the ends thereof. The cord member is of a length such that in a relaxed state, it lies substantially flat against the flexible strip, but will stretch to allow a book to be inserted between the flexible strip and the cord member.

When the device is oriented substantially parallel to the spine of the book, it encircles one of the book cover and a desired number of pages. In this position, the book may be opened or closed without changing the number of pages.

When the book is opened, the device may be rotated so that it is perpendicular to the spine of the book in order that it will encircle the entire width of the open book, from one side of the book to the other. In this position, the book will lie flat and open. In order to turn the pages, the book covers are moved slightly toward each other into a partially closed or V shape. In this position, the flexible strip extends across the open side of the V, and the pages of the book may be turned either forward or backward. When the desired page is selected, the book is opened to a flat state once again, where the device holds it in place.

When the reader wishes to mark the page again, the device may be rotated on the book so that it is parallel to the spine, and encircles only one cover and the desired pages; the book may then be easily closed, marking the desired place in the book.

BRIEF DESCRIPTION OF THE DRAWINGS

The invention will now be described in greater detail with reference to the accompanying drawings which show the invention by way of non-limiting examples, and in which.

DETAILED DESCRIPTION OF PREFERRED EMBODIMENTS

Figure 1:
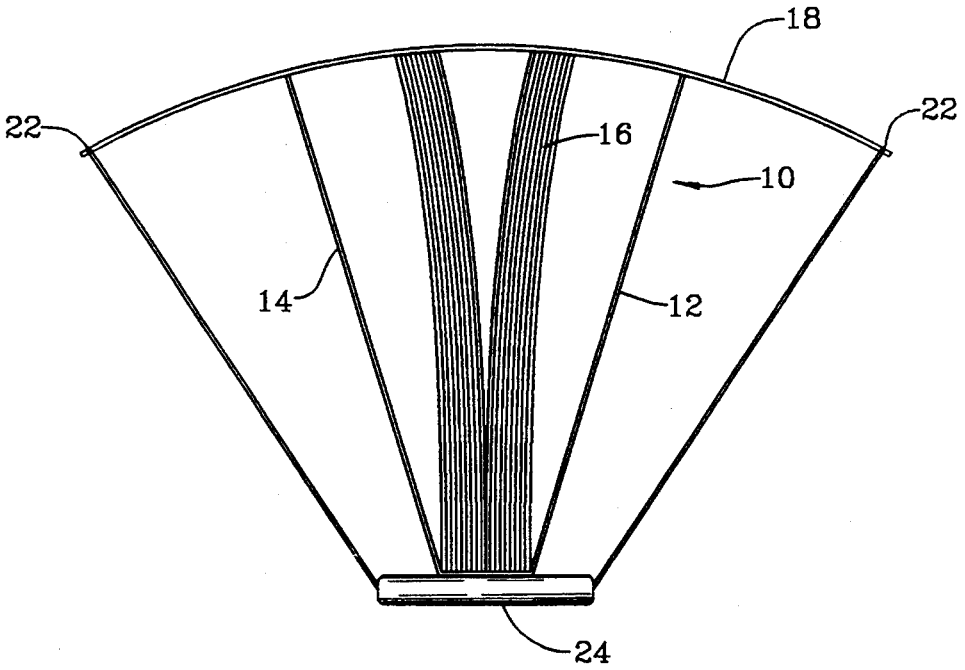
FIG. 1 is a plan view of the combined bookmark and page holder viewed in a direction parallel to the spine of the book and with the book in a partially open state.

Referring to FIG. 1, a book generally designated 10 is shown to include two covers 12, 14 and a number of pages 16. The bookmark comprises a flexible strip 18 which is preferably made of a clear transparent plastic, such as Lexan®. Such material has sufficient strength and flexibility that it may be bowed to the position shown in FIG. 1 without damage. Yet the material does not stretch under normal handling and manipulation. The strip should have a length greater than the width of the book with which it will be used when that book is fully opened and laying flat.

A flexible, stretchable cord-like member 20 is connected to each of the ends of the strip 18, and is of a length such that in a relaxed state, the cord-like member 20 and the strip 18 are of substantially the same length. In other words, when not in use, the cord-like member 20 is not stretched and the strip 18 is not flexed.

In a preferred embodiment, two holes 22 are provided in each end of the strip 18, and the cord-like member 20 is looped through the holes at each end, and the ends of the member 20 are connected, either by tying into a knot or by means of a crimping or ferrule. Then the connected ends are pulled into an axial bore in a block 24 which may be of wood, plastic or other material. This block then may be used to carry any desired indicia, such as a trademark for the product. Of course the block also conceals the connection of the two ends of the member 20, and if a knot is used, the block 24 will also act as a clamp and help to secure the knot against pulling out.

The position shown in FIG. 1 shows the position of the book and the bookmark when it is desired to turn the pages of the book. The book is moved to a position in which the covers are in a V-shape, i.e. partially open, and the pages may be easily turned forward or backward. When it is desired to resume reading, the book is fully opened to the flat position shown in FIG. 2, and the plastic strip 18 overlays the pages being read, while the cord-like member 20 is behind the book. FIG. 3 shows the position of the member 20 and the block 24 at the back of the book.

Figure 2:
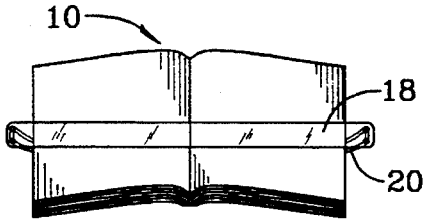
FIG. 2 is a perspective view of the bookmark/page holder showing the book opened with the invention in place.
Figure 3:
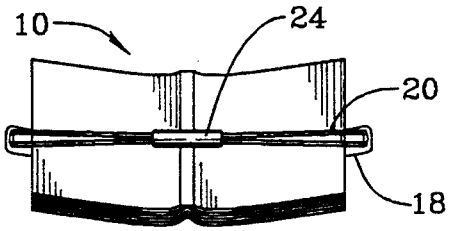
FIG. 3 is a perspective view of the bookmark/page holder showing the opposite side of the device and book from that shown in FIG. 2.
Figure 4:
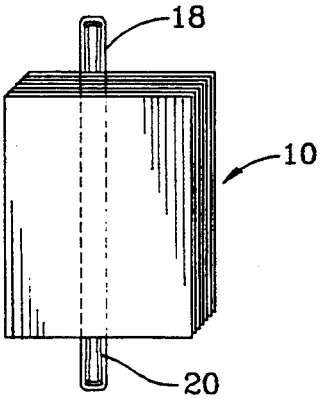
FIG. 4 is a perspective view of a closed book with the bookmark and page holder in position.
Figure 5:
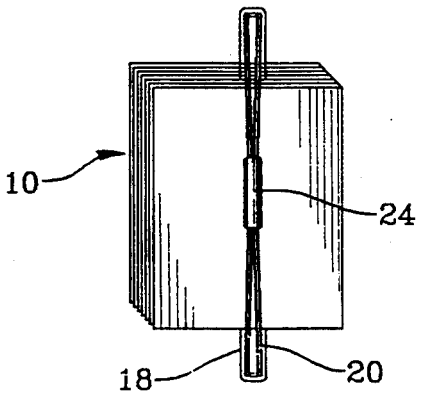
FIG. 5 is a perspective view of the closed book of FIG. 4 viewed from the back side of the book.

From the position shown in FIG. 2, when it is desired to close the book and mark a place in the book, the bookmark is rotated to a position parallel to the spine of the book. Then, the bookmark is placed over either the front or back cover of the book, and the book may be closed, with the strip 18 between the pages marking the desired place in the book, and the cord-like member 20 outside the book as shown in FIGS. 4 and 5.

The position shown in FIG. 1 is a result of both the flexing of the strip 18 and the stretching of the cord-like member 20. It has been found that both the stretching and the flexing actions are needed in order to properly accommodate the page turning without damaging the book covers or pages, and to accommodate both holding the book open in a flat position, as shown in FIGS. 2 and 3, and enable use as a bookmark as shown in FIGS. 4 and 5.

While this invention has been described as having certain preferred features and embodiments, it will be understood that it is capable of still further variation and modification without departing from the spirit of the invention, and this application is intended to cover any and all variations, modifications and adaptations of the invention as may fall within the spirit of the invention and the scope of the appended claims.

We claim:

1. A bookmark page holder device for holding pages of a book and marking a place in a book comprising an elongated strip of a flexible, non-extendible material of a length greater than the width of the book when opened, a flexible, extendible cord-like member connected to said elongated strip near the ends thereof and being of a length such that said member is in a substantially unstretched state when not in use, said strip and said member having sufficient respective flexibility and extendibility as to extend over the full width of a book when opened and whereby said member will stretch as said book is moved from a full open position to a partial open position to allow turning of the pages of the book, said elongated strip being transparent and said member comprising an elastic cord, and wherein the ends of said elastic cord are looped through said elongated strip and joined together near the midpoint of said strip.

2. A bookmark page holder device as in claim 1 and including clamp means for joining the ends of said elastic cord.

3. A bookmark page holder device as in claim 2 and wherein said member comprises a doubled strand of elastic cord looped through each end of said strip.

* * * * *